US007246410B2

(12) United States Patent
Worwag

(10) Patent No.: US 7,246,410 B2
(45) Date of Patent: Jul. 24, 2007

(54) VACUUM CLEANING TOOL HAVING AN AIR TURBINE WITH STABILIZING AIR STREAM

(75) Inventor: Peter Worwag, Staad (CH)

(73) Assignee: Düpro AG, Romanshorn (CH)

( * ) Notice: Subject to any disclaimer, the term of this patent is extended or adjusted under 35 U.S.C. 154(b) by 695 days.

(21) Appl. No.: 10/707,558

(22) Filed: Dec. 21, 2003

(65) Prior Publication Data

US 2004/0123417 A1 Jul. 1, 2004

(51) Int. Cl.
*A47L 9/04* (2006.01)

(52) U.S. Cl. ..... 15/387

(58) Field of Classification Search ..... 15/377, 15/385

See application file for complete search history.

(56) References Cited

U.S. PATENT DOCUMENTS

| | | | | |
|---|---|---|---|---|
| 5,293,665 | A * | 3/1994 | Worwag | 15/387 |
| 5,802,666 | A | 9/1998 | Jung | 15/387 |
| 5,907,888 | A | 6/1999 | Oh | 15/326 |
| 2002/0120999 | A1 | 9/2002 | Worwag | 15/387 |

FOREIGN PATENT DOCUMENTS

| | | |
|---|---|---|
| EP | 1120075 | * 1/2000 |
| JP | 11-318778 | * 11/1999 |

OTHER PUBLICATIONS

Patent Abstracts of Japan, Title: Suction Device for Vacuum Cleaner and Vacuum Cleaner, Publication No. 11318778, Publication Date Nov. 24, 1999, Matsushita Electric Ind. Co. Ltd.

* cited by examiner

*Primary Examiner*—Terrence R. Till
(74) *Attorney, Agent, or Firm*—Gudrun E. Huckett

(57) ABSTRACT

A vacuum cleaning tool has a housing having a turbine chamber and a bottom plate. A working tool is rotatably supported in the housing. An air turbine for driving the working tool is arranged in the turbine chamber and has axial end faces defining a gap relative to the chamber sidewalls. A turbine chamber wall has a first intake window and at least one second intake window. The first intake window supplies a driving suction air stream to the peripheral turbine surface on a first side of a plane that extends through the turbine axis. The second intake window supplies a partial suction air stream to the turbine chamber that enters the turbine chamber on a second side of the plane extending through the turbine axis. The second intake window overlaps at least partially at least one gap and the partial suction air stream flows into the gap.

12 Claims, 3 Drawing Sheets

VACUUM CLEANING TOOL HAVING AN AIR TURBINE WITH STABILIZING AIR STREAM

BACKGROUND OF INVENTION

1. Field of the Invention

The invention relates to a vacuum cleaning tool, in particular, for a vacuum cleaning device such as a vacuum cleaner or the like. The vacuum cleaning tool comprises a rotatingly driven working tool and has a housing with a bottom plate and a working slot formed in the bottom plate. The working tool that is rotatably supported in the housing acts through the working slot onto the surface to be cleaned on. The vacuum cleaning tool comprises an air turbine arranged in a turbine chamber of the housing and has axial end faces forming together with the sidewalls of the turbine chamber a gap, respectively. The turbine drives the working tool by means of a drive connection. In one turbine chamber wall of the turbine chamber, a first intake window for a driving suction air stream and a second intake window for a partial suction air stream are provided, wherein the driving suction air stream is supplied on one side of the rotational axis of the turbine to the peripheral turbine surface and wherein the partial suction air stream enters the turbine chamber on the opposite side of the rotational axis of the turbine.

2. Description of the Related Art

US-2002-0120999-A1 discloses a vacuum cleaning tool where the air turbine is not only loaded by a driving air stream on one side of the rotational axis of the turbine but, in addition, on the other side of the rotational axis a partial suction air stream is provided that is also directed onto the periphery of the turbine. The driving suction air stream rotates the air turbine in the rotational direction while the partial suction air stream entering the turbine chamber impacts the turbine vanes in a direction counter to the rotational direction and is designed to act in a decelerating way. In this way, the intake window for the incoming suction air stream as well as the intake window for the decelerating partial suction air stream are formed with a smaller axial width than the width of the turbine. This is supposed to prevent that portions of the suction air stream remain unused.

The intake window of the partial suction air stream is adjustable with regard to its cross-section so that the desired rotational speed of the air turbine can be adjusted. In this way, a powerful vacuum cleaning tool with rotating brush roller is provided that can be easily adjusted to the momentary application, respectively. A disadvantage is that as a result of the air turbine used for driving a certain design-related noise level will result.

SUMMARY OF INVENTION

It is an object of the present invention to further develop a vacuum cleaning tool of the aforementioned kind having an air turbine as a drive unit for a working tool such that the noise level of the drive is lowered.

In accordance with the present invention, this is achieved in that the cross-sectional area of the second intake window extends at least partially into the area of the gap between the axial end face of the air turbine and the turbine chamber side wall such that a portion of the partial suction air stream entering through the second intake window flows into the gap.

The cross-sectional area of the second intake window extends axially past the axial turbine end face so that the cross-sectional area of the second intake window at least partially covers the gap between the turbine end face and the turbine chamber side wall. In this way, it is achieved that in contrast to the previous measures a portion of the suction air stream entering through the second intake window is directed into the gap between the axial end face of the air turbine and the turbine chamber side wall. The air cushion that is formed as a result of the flow conditions in the gap delimits the axial movements of the rotating air turbine that result inevitably because of mounting, bearing and manufacturing tolerances. The air stream that enters the gap dampens thus the axial movement of the turbine, and this results in a noise level reduction. In this way, a noise reduction of the drive can be achieved in a simply way with an otherwise unchanged configuration of the drive without this causing disadvantageous and noticeable power losses.

Preferably, an intake window is arranged on both axial end faces of the air turbine, respectively, so that the air turbine extends at its axial ends through the air volumes flowing through the gaps. In this way, the air turbine is axially held between air cushions wherein even at very high rotational speeds axial vibrations of the air turbine are substantially prevented. The resulting noise reduction is significant.

Preferably, the turbine end face is positioned in a plane which extends through the second intake window. A portion of the turbine edge that is formed by the plane of the axial end face of the air turbine and the peripheral surface of the turbine can be designed to lie within the second intake window. In this way, the stabilizing air stream attacks in the corner area of the turbine; in this connection, the intake windows are extended advantageously into the area of the turbine circumference. In a special configuration, the two intake windows arranged at the axial end faces are connected to form a common intake slot that has its greatest length in the axial direction of the rotational axis of the turbine that is longer than a surface line measured in the axial direction of the peripheral turbine surface.

Preferably, the ratio q/Q of the passage surface area q of the intake window or the sum of the intake windows for the partial suction air stream relative to the passage surface area Q of the intake window for the driving suction air stream is such that it is in a range of approximately less than 1.

DETAILED DESCRIPTION

Figure 1:
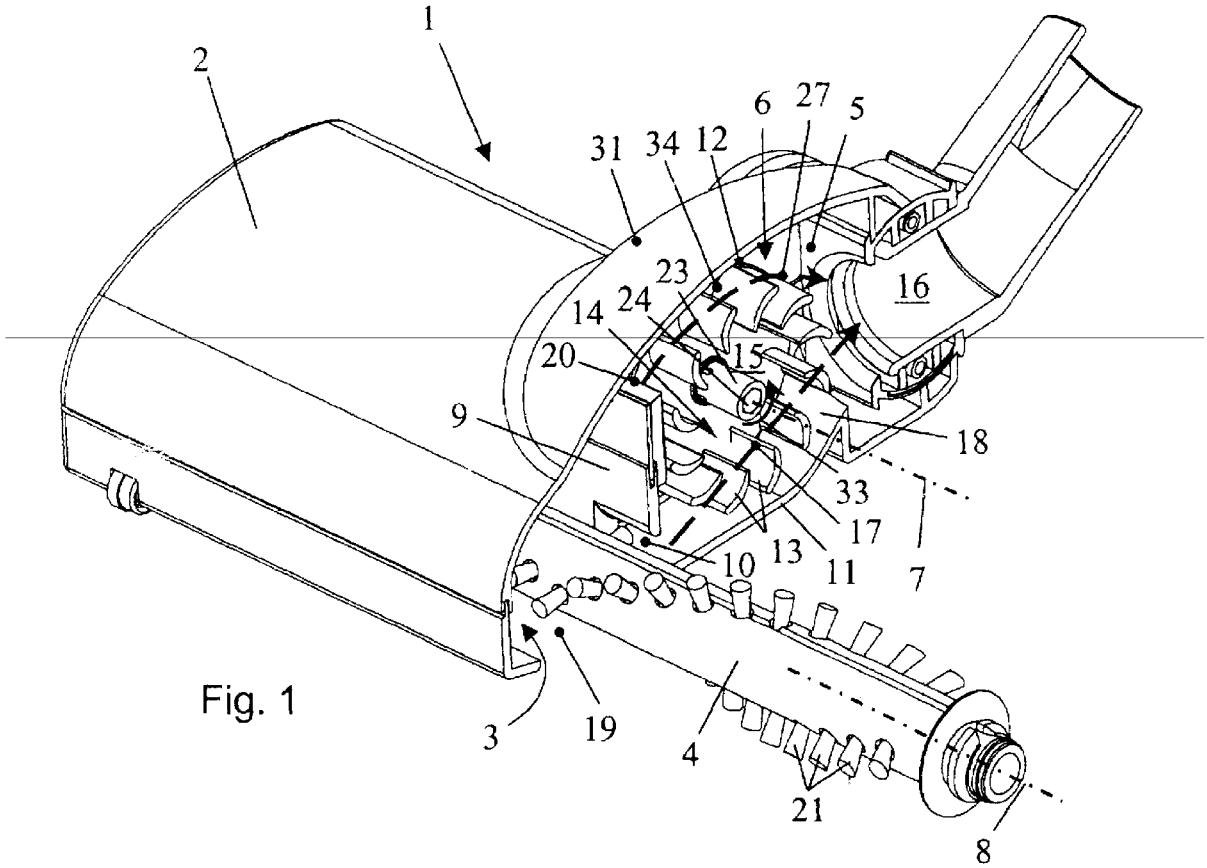
FIG. 1 is a schematic illustration of a vacuum cleaning tool according to the invention in a partial section view.

The vacuum cleaning tool 1 illustrated in FIG. 1 is comprised of a housing 2 that, in a plan view, has approximately the shape of a horizontally positioned T. The transverse beam of the T forms essentially the working chamber 3 in which a rotatingly driven working tool 3 in the form of a brush roller is rotatably supported. In the longitudinal beam of the T, a turbine chamber 5 is formed that is arranged approximately centrally relative to the working chamber 3. In the turbine chamber, an air turbine 6 is arranged whose rotational axis 7 is essentially parallel to the axis of rotation 8 of the working tool 4. The partition 9 arranged between the turbine chamber 5 and the working chamber 3 has a first intake window 10 for a driving suction air stream 17 and a second intake window 20 for a partial suction air stream 27, wherein the two windows 10, 20 are arranged on opposite sides relative to a plane extending through the rotational axis 7. The first intake window 10 is arranged at the level of the bottom plate 11 of the vacuum cleaning tool 1 and supplies the driving suction air stream 17 to the air turbine 6. This air stream is guided directly onto the peripheral turbine surface 12.

Figure 2:
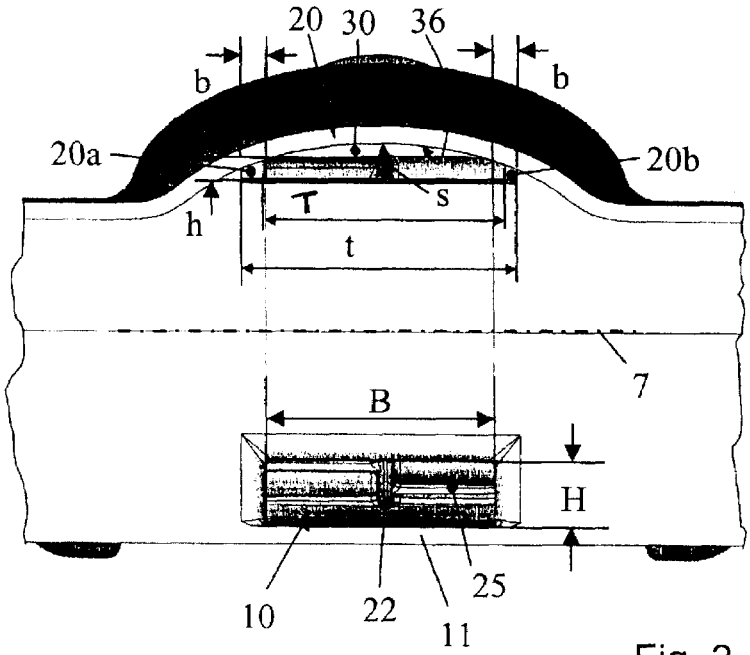
FIG. 2 is a schematic illustration showing an end view of the turbine chamber wall with intake windows for the suction air stream.

As illustrated in FIG. 2, the width B of the first lower intake window 10 is smaller than the axial width T of the turbine 6.

The turbine 6 is a so-called flow-through turbine. In such a configuration, between two neighboring vanes 13 a flow channel 14 is delimited that extends into the center 15 of the flow-through turbine. The air stream that enters the center 15 leaves the center 15 in the oppositely positioned turbine area and flows out through an outlet socket 16. The flow direction of the driving suction air stream 17 is thus inclined upwardly from the intake opening 10 to the outlet socket 16. A flow ramp 18 that extends from the bottom plate 11 upwardly to the level of the outlet socket 16 contributes to maintaining this flow direction. A vacuum cleaning device such as a vacuum cleaner or the like is connected to the outlet socket 16 so that the suction air stream flows through the working slot 19 provided in the bottom plate 11 into the working chamber 3, passes through the first intake window 10 into the turbine chamber 5, flows through the turbine 6 and drives the turbine 6, and then exits through the outlet socket 16. The periphery of the working tool 4, in the illustrated embodiment the bristle arrangement 21 of the brush roller, projects through the working slot 19 in order to act on the surface to be cleaned.

Figure 6:
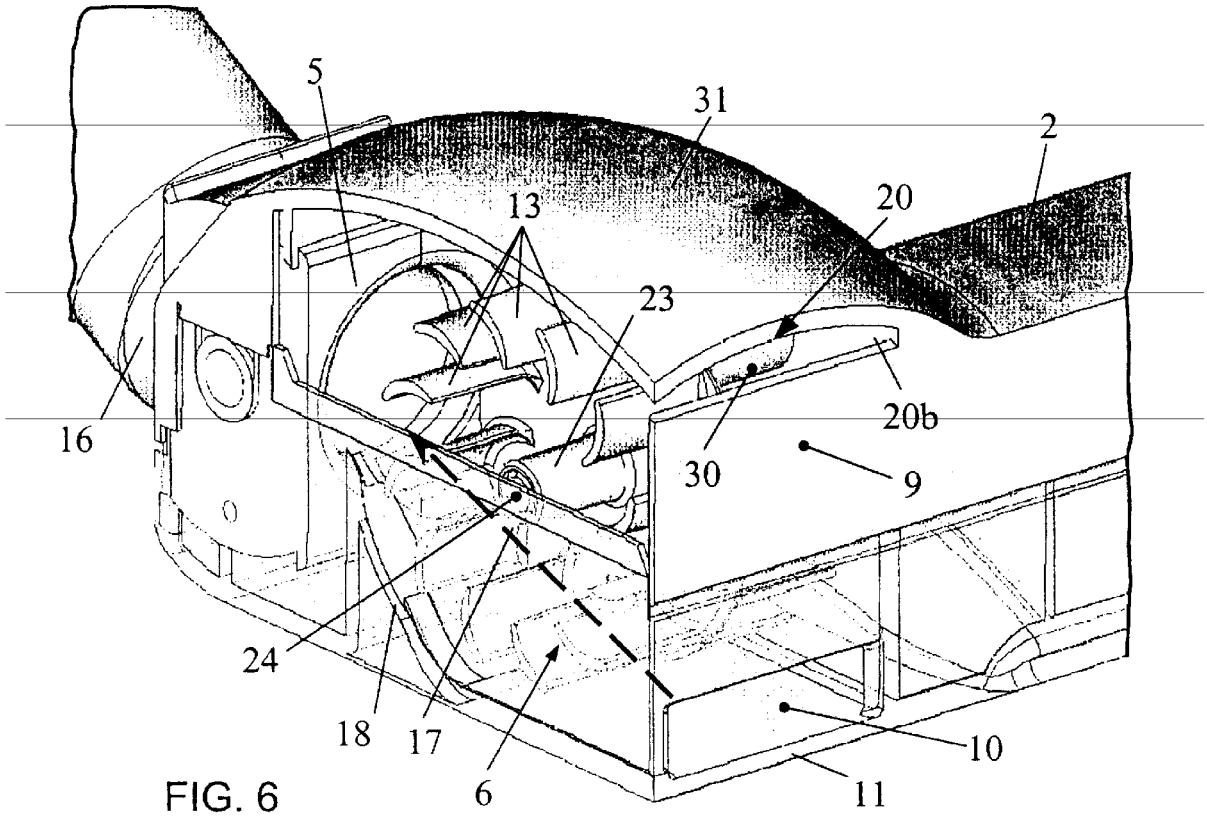
FIG. 6 is a perspective view of a section of a turbine chamber with intake windows according to the invention.

The air turbine 6, as is illustrated in particular in FIGS. 1, 2 and 6, is comprised of a central support disk 22 provided on both end faces with laterally projecting support sleeves 23 through which the turbine shaft 24 is guided. The air turbine 6 supports on both end faces of the support disk 22 a turbine vane arrangement 25 wherein the vanes of one side are preferably displaced in the circumferential direction relative to the vanes of the other side. Each vane 13 is secured with one vane end on the support disk 22. The other vane end projects freely into the turbine chamber 5. The free ends of the vanes 13 form an axial terminal end face 26 that is positioned at a minimal spacing d relative to the axial turbine chamber side walls 28.

The turbine 6 drives the working tool 4 in rotation by means of a toothed gearing, a belt drive, a friction gear drive, a wedge friction gear drive, or the like.

The driving suction air stream 17 enters the turbine chamber 5 through the first intake window 10 and loads the air turbine 6 on a side of the rotational axis 7 of the turbine so that the drive of the air turbine 6 about the rotational axis 7 of the turbine is achieved.

Figure 3:
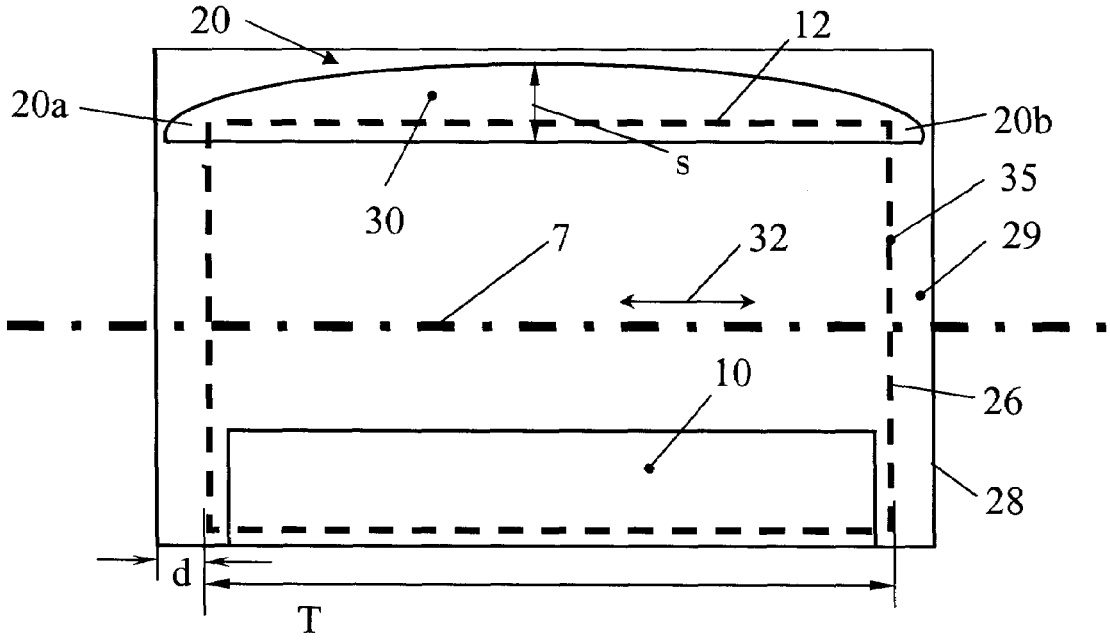
FIG. 3 shows in a schematic illustration a view of the turbine chamber wall in a first configuration of the intake windows for a partial suction air stream.

Through the second intake window 20, that according to the illustrated embodiment of FIGS. 2, 3, and 6, is formed as an intake slot 30 that extends substantially across the width, preferably across the entire width of the turbine chamber 5, a partial suction air stream 27 enters in the area of the turbine chamber roof 28 and acts as a stabilizing air stream on the rotating turbine 6 in the turbine chamber. For this purpose, the intake slot 30, measured in axial direction of the rotational axis 7 of the turbine, has a length t that is greater than the corresponding axial turbine length T (see FIG. 2). In this way it is ensured that the components of the partial suction air stream 27 flow through the gap 29 arranged between the turbine end face 26 and the axially opposed turbine chamber side wall 28, respectively. The cross-sectional area of the second intake window 20 extends thus axially past the turbine end face 26 and covers or overlaps the gap 29 at least partially, as illustrated particularly in FIGS. 2 through 5. At least a portion of the partial suction air stream 27 entering through the second intake window 20 reaches thus the gap 29 between the axial end face 26 of the air turbine 6 and the turbine chamber wall 28. In this way, on both end faces 26 of the air turbine 6 an air cushion is formed in the gap 29 and prevents the turbine from carrying out axial movements in the direction of the double arrow 32; such design-based axial movements are possible as a result of mounting play, manufacturing tolerances and the like. The idea of directing air in a targeted fashion past the axial end faces of the turbine 6 results thus in a quiet running with significantly reduced axial movements of the turbine 6.

As shown in FIGS. 2 and 3, the intake window 20, formed as an intake slot 30, extends across more than the axial length T of the air turbine 6. In the circumferential area of the turbine 6 in the area of the turbine chamber roof 31, an air stream 27 flows also into the turbine chamber counter to the rotational direction 33. Since between the peripheral turbine surface 12 and the turbine chamber roof 31 a spacing is provided, a flow path 34 is formed between the peripheral turbine surface 12 and the turbine chamber roof 31 through which a further portion of the partial suction air stream 27 can flow. The air stream generated between the turbine chamber roof 31 and the peripheral turbine surface 12, which can also lead to an air cushion, enhances also the stabilization of the turbine.

In practice, it was found that air turbines that are driven exclusively by means of an air stream guided through one air intake window cannot only perform movement in the axial direction but can also vibrate or oscillate in the circumferential direction in operation; this can also lead to noise generation. The partial air stream 27 that is supplied in a direction counter to the rotational direction 33 between the turbine chamber roof 31 and the peripheral turbine surface 12 of the turbine chamber has a secondary decelerating effect but results in a significant reduction of the circumferential oscillations of the turbine so that the turbine operates at a highly constant rotational speed. In combination with the additional concept of the invention of passing air through the gap between the turbine end faces 26 and the turbine chamber side walls 28, a driving air turbine is provided that is quiet and has a constant rotational speed. In this way, across the operational rotational speed range of the air turbine a significant noise reduction is obtained without affecting the driving power of the turbine in a negative way.

As shown in the illustrated embodiments, the axial turbine end face 26 is positioned in a plane that extends through the intake window 20 overlapping the gap. In the intake window 20, a portion of the turbine edge 35 that is formed by the plane of the axial end face 26 and the peripheral turbine surface 12, is visible. In order to generate a suitable flow that engages the entire air turbine 6 in the area of the turbine chamber roof 31, the intake slot 30 in the central area of its length is provided with a maximum height s that is greater than the height of the intake slot in the area of its ends. In this connection, the intake slot 30 has a shape like a flattened circular section; advantageously, it has a shape of approximately a semi-ellipse, wherein the upper edge 36 of the intake slot 30 facing away from the rotational axis 7 of the turbine and the turbine chamber roof 31 are shaped approximately identically, in particular, with identical curvature.

It was found to be advantageous when the ratio q to Q of the passage surface area q of the second intake window 20 for the partial suction air stream 27 to the passage surface area Q of the intake window 10 for the driving suction air stream 17 is in a range that is less than 1. In this connection, the width b of the second intake window 20*a*, 20*b* can be preferably significantly greater than the maximum height h of the intake window 20*a*, 20*b*.

Figure 4:
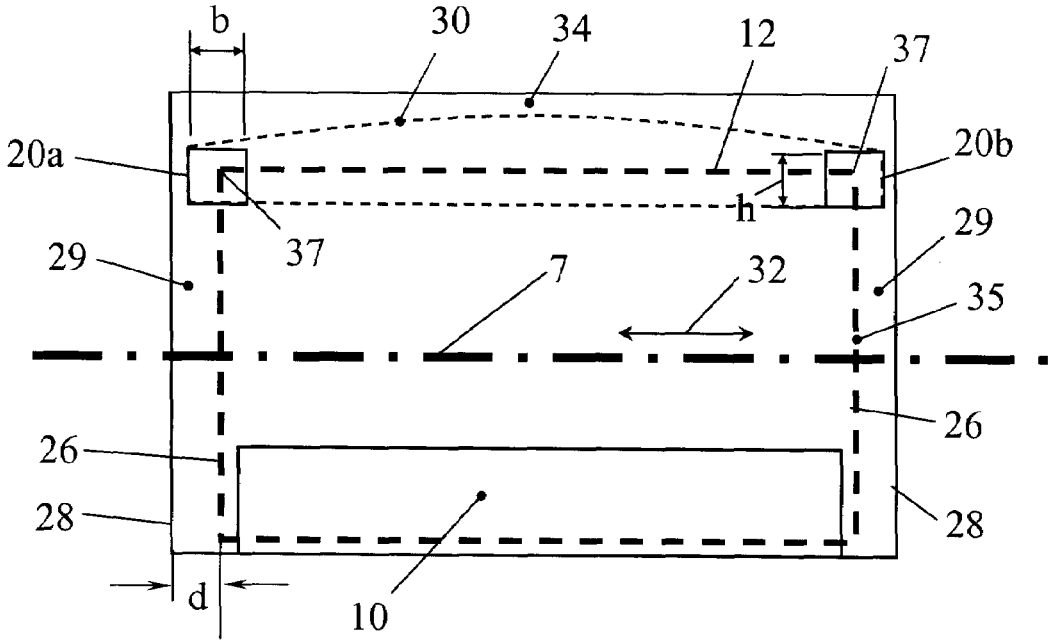
FIG. 4 is a schematic illustration of an end view of a turbine chamber wall with intake windows arranged in the corner area of the turbine.

For obtaining a significant lowering of the operational noise of the air turbine 6, the arrangement of intake windows 20*a* and 20*b* at both axial end faces 26 of the air turbine 6 is sufficient. As illustrated in FIG. 4, the intake window 20*a*, 20*b* can be arranged such that the corner area 37 of the turbine 6 viewed in the flow direction of the incoming air stream is located within the intake window 20*a*, 20*b*. The intake window 20*a*, 20*b* covers or overlaps thus the corner area 37.

When computing the ratio q/Q, the passage surface area q of the two intake windows 20*a* and 20*b* is added so that the entire surface area is taken into account.

Figure 5:
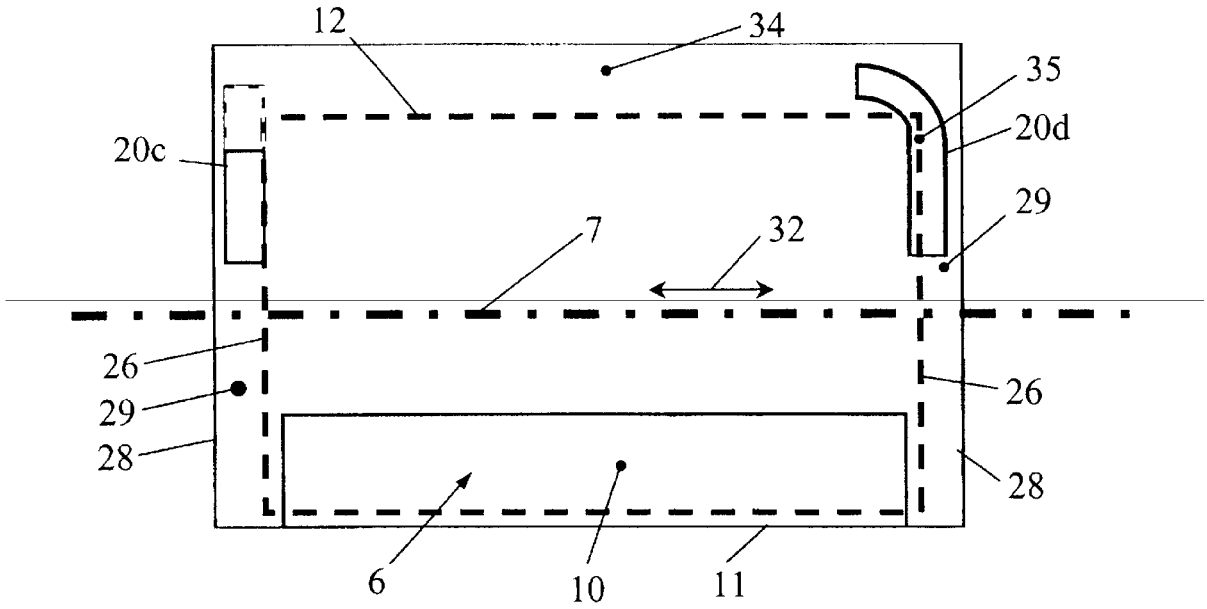
FIG. 5 is a view according to FIG. 3 showing different configurations of the intake windows for the partial suction air stream.

As illustrated in FIG. 5, an intake window 20*c* can be arranged such that it opens exclusively into the gap 29 between the air turbine end face 26 and the chamber side wall 28. The position of the intake window 20*c* can be near the rotational axis 7 of the air turbine 6. Preferably, the intake window 20*c* is positioned on the side of the rotational axis 7 of the air turbine opposite the intake window 10.

It can be advantageous that the intake window 20*d* extends to the peripheral turbine area. The intake window 20*d* thus does not open only into the gap 29 but also into the flow path 34 formed between the turbine chamber roof 31 and the peripheral turbine surface 12. However, in a preferred configuration, the intake windows 20*a*, 20*b*; 20*c*, 20*d* provided at the two axial end faces 26 of the turbine 6 are connected to one another to form a common intake slot 30, as illustrated in FIGS. 1 through 3 and 6.

The cross-sectional shape of an intake window 20*a*, 20*b*, 20*c*, 20*d* can be selected as desired. Preferably, cross-sectional shapes are provided that cover the gap 29 as well as the flow path 34 in order to provide a simultaneous air feed laterally of the air turbine end faces 26 into the gap 29 and into the flow path 34 between the turbine chamber roof 31 and the peripheral turbine surface 12.

While specific embodiments of the invention have been shown and described in detail to illustrate the inventive principles, it will be understood that the invention may be embodied otherwise without departing from such principles.

What is claimed is:

1. A vacuum cleaning tool for a vacuum cleaning device, the vacuum cleaning tool comprising:

a housing having a turbine chamber and a bottom plate, wherein the bottom plate has a working slot;

a rotatingly driven working tool rotatably supported in the housing so as to act through the working slot onto a surface to be worked on;

an air turbine arranged in the turbine chamber and having opposed axial end faces forming a gap together with side walls of the turbine chamber, respectively;

wherein the air turbine is drivingly connected to the working tool for driving the working tool;

wherein a turbine chamber wall of the turbine chamber has a first intake window and at least one second intake window, wherein the first intake window supplies a driving suction air stream to the air turbine and the at least one second intake window supplies a partial suction air stream to the turbine chamber;

wherein the driving suction air stream is supplied to a peripheral turbine surface on a first side of a plane that extends through a rotational axis of the air turbine and wherein the partial suction air stream enters the turbine chamber on a second side of the plane extending through the rotational axis of the air turbine;

wherein a cross-sectional area of the at least one second intake window overlaps at least partially at least one of the gaps such that a portion of the partial suction air stream flows into the at least one gap.

2. The vacuum cleaning tool according to claim 1, wherein two of the second intake windows are provided, wherein each one of the gaps has one of the two second intake windows arranged thereat.

3. The vacuum cleaning tool according to claim 2, wherein the two second intake windows are connected to form a common intake slot.

4. The vacuum cleaning tool according to claim 3, wherein the common intake slot has a length, in an axial direction of the rotational axis of the air turbine, that is longer than a surface line of the peripheral turbine surface.

5. The vacuum cleaning tool according to claim 3, wherein the intake slot in an axial direction of the rotational axis of the air turbine has centrally a maximum height that is greater than a height at slot ends of the common intake slot.

6. The vacuum cleaning tool according to claim 3, wherein the common intake slot has approximately a shape of a flattened circular section.

7. The vacuum cleaning tool according to claim 6, wherein the common intake slot has a shape of a semi-ellipse.

8. The vacuum cleaning tool according to claim 6, wherein an upper edge of the common intake slot facing away from the rotational axis of the air turbine and a turbine chamber roof have approximately a same curvature.

9. The vacuum cleaning tool according to claim 1, wherein the axial end face of the at least one gap that is overlapped by the cross-sectional area of the at least one second intake window is positioned in a plane extending through the at least one second intake window.

10. The vacuum cleaning tool according to claim 1, wherein the axial end faces and the peripheral turbine surface define a turbine edge, wherein a portion of the turbine edge is located in the at least one second intake window.

11. The vacuum cleaning tool according to claim 1, wherein the at least one second intake window extends into an area of the peripheral turbine surface.

12. The vacuum cleaning tool according to claim 1, wherein the ratio q/Q of a passage surface area q of the at least one second intake window relative to a passage surface area Q of the first intake window is smaller than 1.

* * * * *